US011530534B2

(12) United States Patent
Daysh et al.

(10) Patent No.: US 11,530,534 B2
(45) Date of Patent: Dec. 20, 2022

(54) DRY-STACK MASONRY WALL SUPPORTED ON HOLLOW PILES

(71) Applicant: Daysh Developments, Inc., Benicia, CA (US)

(72) Inventors: Paul Daysh, Concord, CA (US); Howard Perko, Fort Collins, CO (US); Troy Lyver, Portland, OR (US)

( * ) Notice: Subject to any disclaimer, the term of this patent is extended or adjusted under 35 U.S.C. 154(b) by 0 days.

(21) Appl. No.: 17/383,235

(22) Filed: Jul. 22, 2021

(65) Prior Publication Data

US 2021/0348385 A1 Nov. 11, 2021

Related U.S. Application Data

(63) Continuation of application No. 16/516,159, filed on Jul. 18, 2019, now Pat. No. 11,066,827, which is a continuation-in-part of application No. 29/640,572, filed on Mar. 15, 2018, now Pat. No. Des. 854,709.

(60) Provisional application No. 62/700,765, filed on Jul. 19, 2018.

(51) Int. Cl.

| | |
|---|---|
| ***E04B 2/46*** | (2006.01) |
| ***E04B 2/02*** | (2006.01) |
| ***E04B 1/84*** | (2006.01) |

(52) U.S. Cl.

CPC ..... *E04B 2/46* (2013.01); *E04B 1/8404* (2013.01); *E04B 2001/849* (2013.01); *E04B 2002/0206* (2013.01)

(58) Field of Classification Search

CPC . E04B 1/8404; E04B 2/42; E04B 2/46; E04B 2/48; E04B 2/52; E04B 2/54; E04B 2001/849; E04B 2002/0206

See application file for complete search history.

(56) References Cited

U.S. PATENT DOCUMENTS

| | | | |
|---|---|---|---|
| 816,631 | A | 4/1906 | Widmer |
| 839,822 | A | 1/1907 | Dunnington |
| 1,109,020 | A | 9/1914 | Skiff et al. |
| 1,283,246 | A | 10/1918 | Maloney et al. |
| 1,336,773 | A | 4/1920 | William |
| 1,388,031 | A | 8/1921 | Ryton |
| 1,791,368 | A | 2/1931 | Mullett |
| 1,849,268 | A | 3/1932 | Theodore |
| 1,883,477 | A | 10/1932 | Bash |
| 2,191,217 | A | 2/1940 | Liebowitz |
| 2,380,692 | A | 7/1945 | Foster |
| 2,530,940 | A | 11/1950 | Dahlin |
| 2,684,589 | A | 7/1954 | Perreton |

(Continued)

FOREIGN PATENT DOCUMENTS

| | | | |
|---|---|---|---|
| DE | 880930 | C | 6/1953 |
| FR | 2486984 | A1 * | 1/1982 |
| FR | 2512090 | A1 | 3/1983 |

*Primary Examiner* — Christine T Cajilig

(74) *Attorney, Agent, or Firm* — Brian Beverly; Beeson Skinner Beverly, LLP

(57) ABSTRACT

A dry-stack masonry wall supported on hollow piles includes a wall having a plurality of stacked rows of masonry blocks that form a hollow interior grid of horizontal and vertical channels. The wall is supported on piles having hollow interiors, each of which is in communication with one of the vertical channels of the wall. Hardened grout filling the grid of the wall and the interiors of the piles monolithically binds the blocks into a wall which is bonded to and supported by the piles.

7 Claims, 10 Drawing Sheets

(56) References Cited

U.S. PATENT DOCUMENTS

| | | | |
|---|---|---|---|
| 2,772,560 | A | 12/1956 | Neptune |
| 3,295,274 | A | 1/1967 | Fulton |
| 3,318,058 | A | 5/1967 | Sullivan |
| 3,645,055 | A | 2/1972 | Roza |
| 3,662,436 | A | 5/1972 | Roza |
| 3,710,523 | A | 1/1973 | Taylor |
| 3,742,661 | A | 7/1973 | Tye |
| 3,750,609 | A | 8/1973 | Chelminski |
| 3,753,354 | A | 8/1973 | Bauer |
| 3,754,401 | A | 8/1973 | Lipow |
| 3,757,528 | A | 9/1973 | Finsterwalder et al. |
| 3,763,610 | A | 10/1973 | Ballew |
| 3,778,944 | A | 12/1973 | Easley |
| 3,793,786 | A | 2/1974 | Jahnke |
| 3,802,476 | A | 4/1974 | Hoadley |
| 3,803,782 | A | 4/1974 | Ballew |
| 3,803,783 | A | 4/1974 | Ballew |
| 3,828,562 | A | 8/1974 | Petres |
| 3,830,315 | A | 8/1974 | Love |
| 3,832,860 | A | 9/1974 | Jahnke |
| 3,832,861 | A | 9/1974 | Jahnke et al. |
| 3,841,032 | A | 10/1974 | Grannis |
| 3,855,745 | A | 12/1974 | Patterson et al. |
| 3,855,804 | A | 12/1974 | Herbst et al. |
| 3,861,097 | A | 1/1975 | Patterson et al. |
| 3,871,142 | A | 3/1975 | Abbott |
| 3,896,890 | A | 7/1975 | Gale |
| 3,903,626 | A | 9/1975 | Ford |
| 3,906,689 | A | 9/1975 | Nakayama |
| 3,942,368 | A | 3/1976 | Hoyt |
| 3,961,671 | A | 6/1976 | Adams et al. |
| 3,971,177 | A | 7/1976 | Endo |
| 4,014,144 | A | 3/1977 | Gale |
| 4,037,373 | A | 7/1977 | Echtler |
| 4,044,513 | A | 8/1977 | Deike |
| 4,127,000 | A | 11/1978 | Montgomery, Jr. et al. |
| 4,142,336 | A | 3/1979 | Gebhart |
| 4,178,726 | A | 12/1979 | Watson |
| 4,189,879 | A | 2/1980 | Patterson |
| 4,251,963 | A | 2/1981 | Patterson |
| 4,287,098 | A | 9/1981 | Farnworth et al. |
| 4,290,245 | A | 9/1981 | Pardue, Jr. et al. |
| 4,316,350 | A | 2/1982 | Watson |
| 4,334,392 | A | 6/1982 | Dziedzic |
| 4,400,114 | A | 8/1983 | Pickett et al. |
| 4,406,100 | A | 9/1983 | Keesee et al. |
| 4,459,787 | A | 7/1984 | Wilcox |
| 4,467,575 | A | 8/1984 | Dziedzic |
| 4,512,132 | A | 4/1985 | Keesee et al. |
| 4,598,511 | A | 7/1986 | Severs et al. |
| 4,633,627 | A | 1/1987 | Tucker |
| 4,634,319 | A | 1/1987 | May |
| 4,708,530 | A | 11/1987 | Faber |
| 4,742,656 | A | 5/1988 | Farmer |
| 4,778,142 | A | 10/1988 | Roba |
| 4,800,700 | A | 1/1989 | May |
| 4,854,782 | A | 8/1989 | May |
| 4,952,096 | A | 8/1990 | McCartney |
| 4,979,341 | A | 12/1990 | Norman et al. |
| 4,996,806 | A | 3/1991 | Platz |
| 4,998,849 | A | 3/1991 | Summers |
| 5,066,168 | A | 11/1991 | Holdeman |
| 5,113,626 | A | 5/1992 | Seider et al. |
| 5,120,163 | A | 6/1992 | Holdeman et al. |
| 5,139,368 | A | 8/1992 | Hamilton et al. |
| 5,145,286 | A | 9/1992 | Summers |
| 5,171,107 | A | 12/1992 | Hamilton et al. |
| 5,175,966 | A | 1/1993 | Remke et al. |
| 5,203,127 | A | 4/1993 | Olthoff et al. |
| 5,224,310 | A | 7/1993 | Edwards et al. |
| 5,295,766 | A | 3/1994 | Tiikkainen |
| 5,408,788 | A | 4/1995 | Hamilton et al. |
| 5,482,407 | A | 1/1996 | Raaf |
| 5,575,122 | A | 11/1996 | Hamilton et al. |
| 5,575,593 | A | 11/1996 | Raaf |
| 5,608,994 | A | 3/1997 | Carter |
| 5,622,015 | A | 4/1997 | Collins |
| 5,913,791 | A | 6/1999 | Baldwin |
| 8,549,811 | B2 | 10/2013 | Dyson |
| 8,820,024 | B1 * | 9/2014 | Abdullah ..... E04B 2/32 52/561 |
| 10,415,241 | B2 | 9/2019 | Simonson et al. |
| 10,472,822 | B1 | 11/2019 | Castro |
| 2007/0151191 | A1 | 7/2007 | August |
| 2014/0059962 | A1 | 3/2014 | O'Connor |
| 2016/0024784 | A1 | 1/2016 | Farrell et al. |
| 2017/0335533 | A1 * | 11/2017 | Chow ..... E04B 2/46 |

* cited by examiner

DRY-STACK MASONRY WALL SUPPORTED ON HOLLOW PILES

CROSS-REFERENCE TO RELATED APPLICATIONS

This application is a continuation of prior application Ser. No. 16/516,159, filed Jul. 18, 2019, which claims the benefit of U.S. Provisional Application No. 62/700,765 filed Jul. 19, 2018, and which is a continuation-in-pad of U.S. Design Pat. application No. 29/640,572, filed Mar. 15, 2018, the entire contents of all of which are incorporated herein by reference.

BACKGROUND

Technical Field

The present invention relates generally to retaining walls and is more particularly related to walls constructed by dry-stacking masonry blocks on foundation piles.

Description of Related Art

Prior art wall systems are constructed on drilled piers with a connecting reinforced grade beam, requiring excavation for the grade beam and drilling for the piers. This creates excess soil, complicates construction processes, requires additional inspections, and results in additional labor and equipment costs, all of which increases project time.

SUMMARY OF THE INVENTION

In one embodiment of the invention, a dry-stack masonry block comprises two spaced-apart face shells connected by one or more interior connectors to form one or more vertical channels. The connectors extend from the bottom of the connected face shells to a height less than that of the face shells to form a horizontal channel on the top part of the block.

A wall is constructed by stacking horizontal rows of the blocks with every other row inverted so that the horizontal channels of the blocks in each such inverted row meet with the horizontal channels of the upright blocks of the row below it. The horizontal and vertical channels of the stacked rows of masonry blocks intersect to form a hollow interior grid which can be filled with grout. Since the halves of each masonry block are horizontally symmetrical, the blocks of each row can be horizontally offset from the blocks of the row immediately below it in a running bond configuration and still form the hollow grid mentioned above.

The dry-stack masonry block of the invention can be cast using less material than prior art blocks, resulting in a lighter, more affordable block, and the stacked configuration allows for ore robust bar reinforcement and overall wall strength and eliminates the need for grade beam footings. The masonry block also enables construction of a mortar-less masonry wall, eliminating the need for transporting, mixing and troweling mortar.

In another embodiment of the invention, a wall constructed from masonry blocks as discussed above is supported on hollow piles. The hollow interiors of the piles communicate with the vertical channels of the grid of horizontal and vertical channels in the wall Grout can be poured into the grid and the interiors of the piles which when hardened creates a monolithic wall supported on the piles. The use of hollow barrel piles in combination with the masonry blocks described above eliminates or significantly reduces excess soil, simplifies construction, reduces inspections, labor and equipment costs, and allows a strong wall to be constructed more quickly.

DETAILED DESCRIPTION OF THE ILLUSTRATED EMBODIMENT

The Masonry Block

Figure 1A:
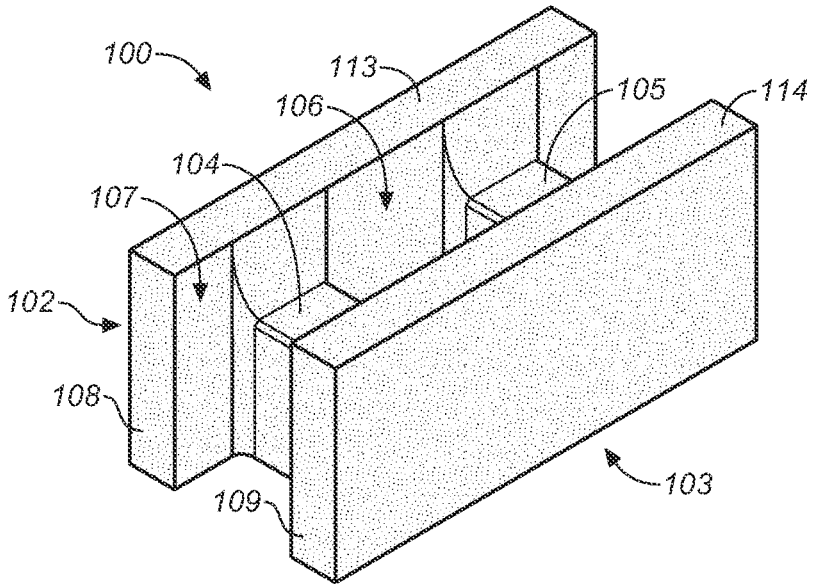
FIG. 1A is a perspective view of a dry-stack masonry block according to the invention.

FIGS. 1 to 4 show a dry-stack masonry block 100 according to the invention. Block 100 is made of two face shells 102 and 103 connected by two interior connectors 104 and 105 to form a double open-ended bond beam masonry block having a vertical center channel 106 and vertical end channels 107.

Figure 1B:
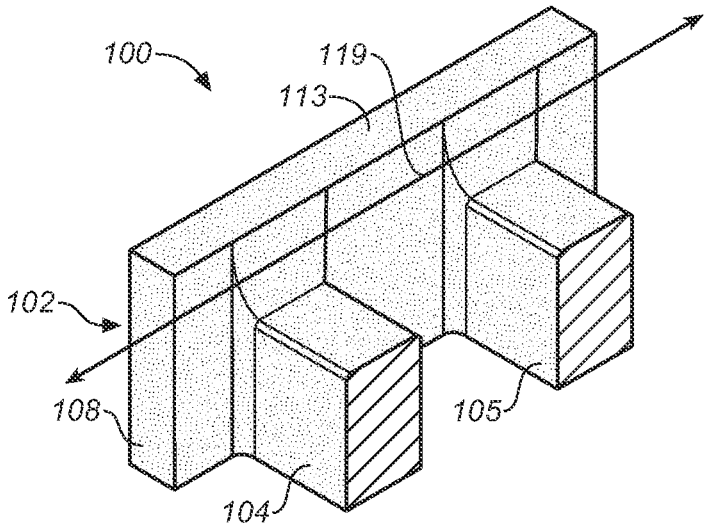
FIG. 1B is a sectional perspective view thereof, taken along line 1B of FIG. 2.
Figures 2, 3, 4:
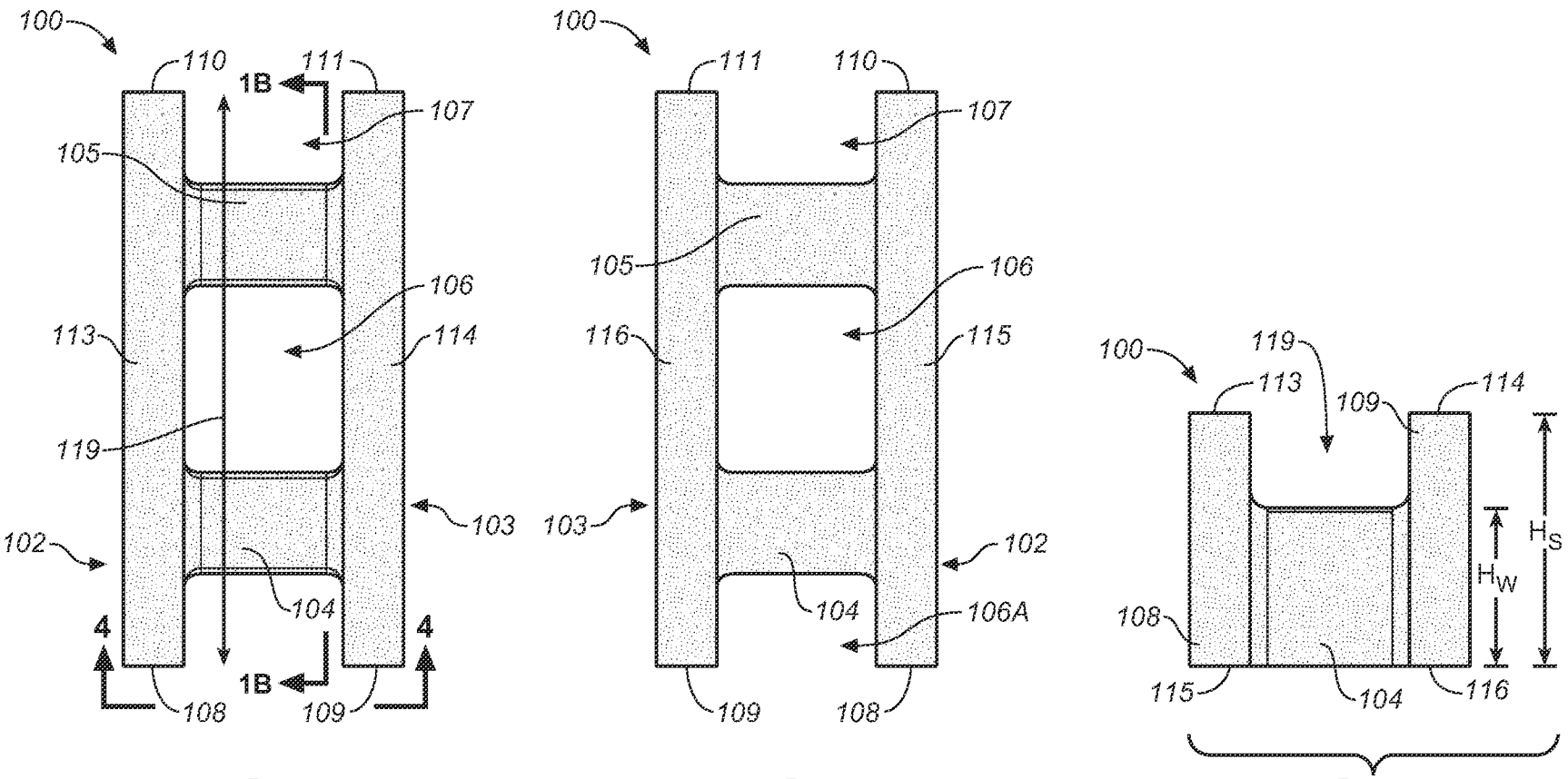
FIG. 2 is a top plan view thereof.
FIG. 3 is a bottom plan view thereof.
FIG. 4 is a side elevational view thereof taken along line 4-4 of FIG. 2.

FIG. 1A is a perspective view of block 100, and FIG. 1B is a sectional perspective view of the block 100 that more clearly shows interior connectors 104 and 105. FIGS. 2 and 3 show top plan and bottom plan views of block 100 respectively.

Face shell 102 has a top edge 113, a bottom edge 115 and side edges 108 and 110. Face shell 103 has a top edge 114, a bottom edge 116 and side edges 109 and 111.

Interior connectors 104 and 105 have a height Hw that extends from the bottom of face sheds 102 and 103 to less than the full height Hs of face shells 102 and 103. As described in detail below with respect to FIGS. 8 and 9, the shortened height Hw of interior connectors 102 and 103 forms a horizontal channel 119 in the top of block 100.

The measurements and proportions of block 100 can vary depending on the particular requirements of a building project. In one embodiment, face shells 102 and 103 are of identical shape and proportion with the height Hs of the face shells (i.e., the length of side edges 108, 109, 110 and 111) being approximately 8 inches, the length of the face shells (i.e., the length of top and bottom edges 113, 114, 115 and 116) being approximately 18 inches, and the width of the face shells being approximately 2 inches. In the same embodiment, interior webs 104 and 105 are also of identical shape and proportion, with the height Hw of the webs being approximately 5.5 inches, the length of the webs being approximately 3 inches and the width of the interior webs (i.e., the spacing between the interconnected face shells) being approximately 5 inches, giving block 100 approximate overall dimensions of 8 inches by 9 inches by 18 inches (typical dimensions used in the construction industry). It should be understood, however, that this is just one exemplary set of dimensions for block 100.

Block 100 can be made of cast concrete (e.g., Portland cement and aggregate, such as sand or fine gravel), or can be made of a lower density building material such as fly ash or bottom ash (as in a cinder block) or foam concrete (e.g., autoclaved aerated concrete). The block 100 can also be formed of any other alternative building materials and/or can be formulated with special aggregates to produce desired coloring or texture.

Method of Constructing a Wall Using the Masonry Block

FIGS. 5 to 9 illustrate a method of dry-stacking a plurality of masonry blocks according to the invention in order to construct a Wythe 300 that can form all or a portion of a wall, such as, for example, a retaining wall, a sound wall, a veneer, or the wall of a building structure.

In the illustrated stacking method, horizontal rows of blocks 100 are stacked one on top of another with the vertical orientation of the blocks alternating between each stacked row (i.e. in a running bond configuration). The blocks can also suitably be arranged in a stacked bond configuration.

Figure 6:
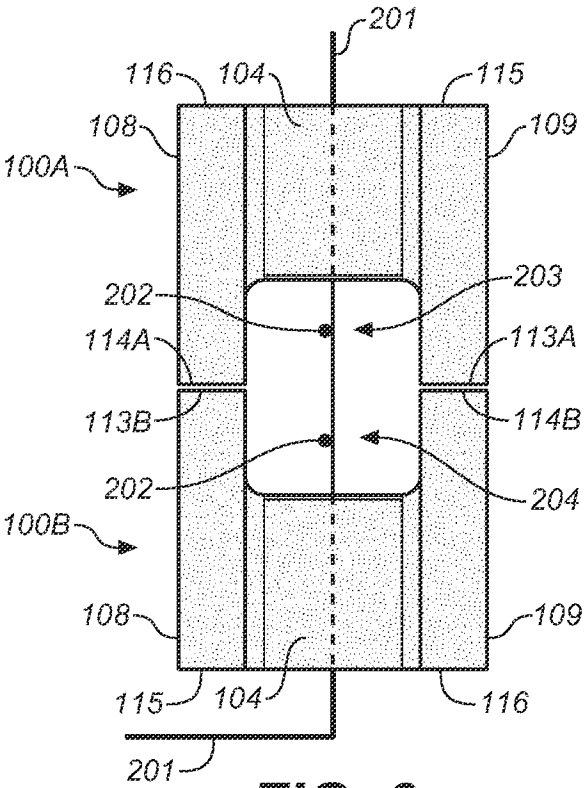
FIG. 6 is a side elevational view similar to FIG. 5 showing structural steel disposed in the channels formed by the blocks.
Figure 5:
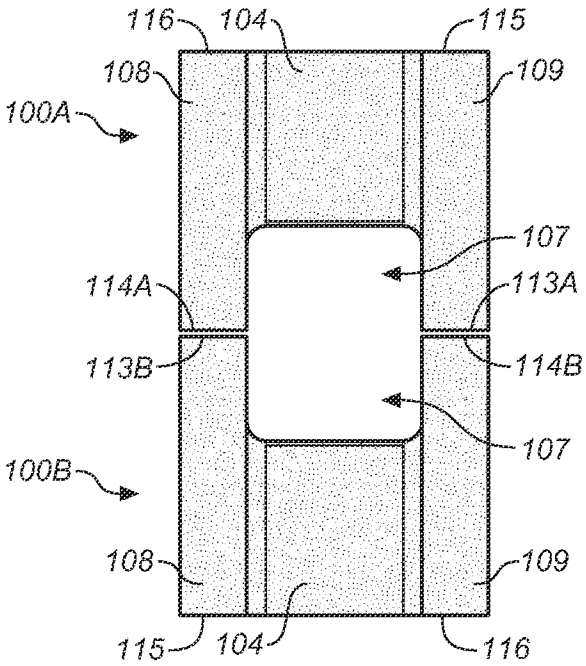
FIG. 5 is a side elevational view of two stacked blocks in accordance with the invention.
Figure 7:
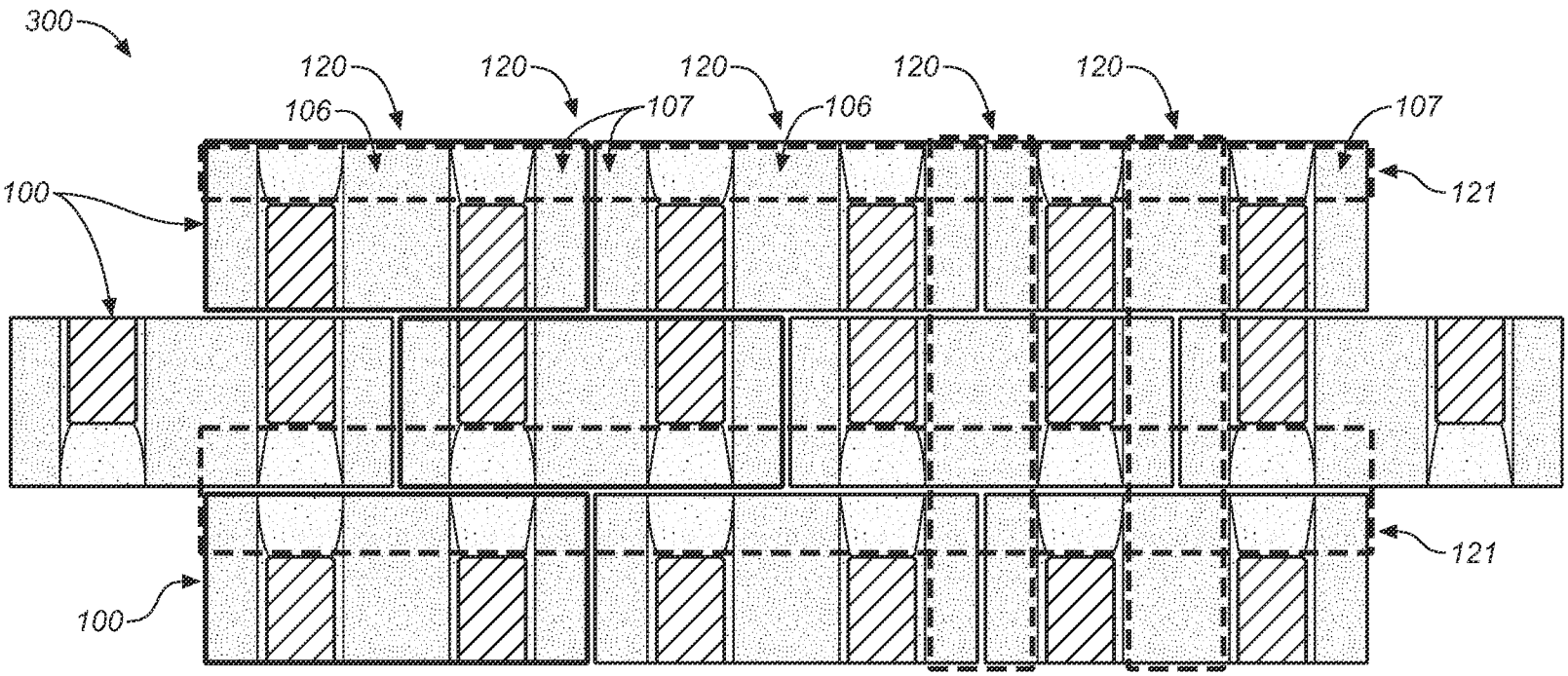
FIG. 7 is a front elevational sectional view of a partially constructed wall including three horizontal roves of stacked blocks according to the invention.
Figure 8:
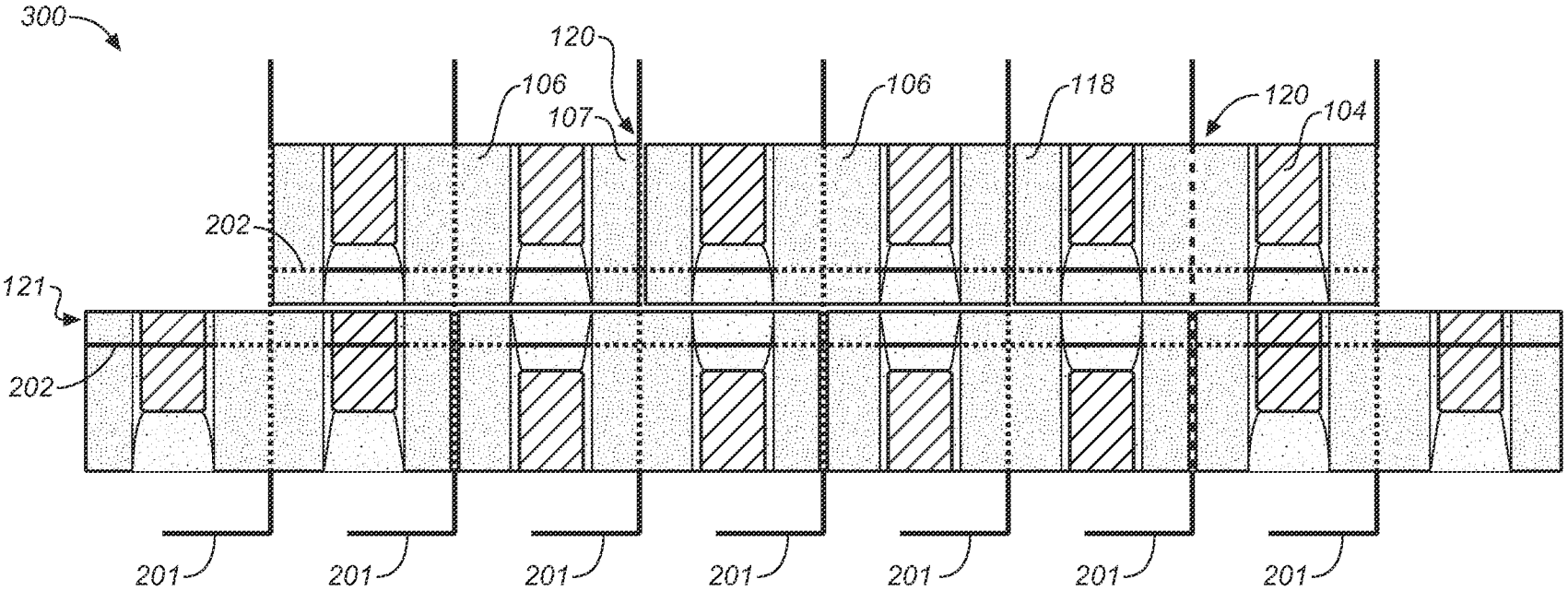
FIG. 8 is a front elevational view of a partially constructed wall showing vertical and horizontal reinforcement bars disposed in the grid of channels formed by the interlacing vertical cores and horizontal channels of the stacked blocks, and showing hollow piles supporting the wall according to the invention.
Figure 9:
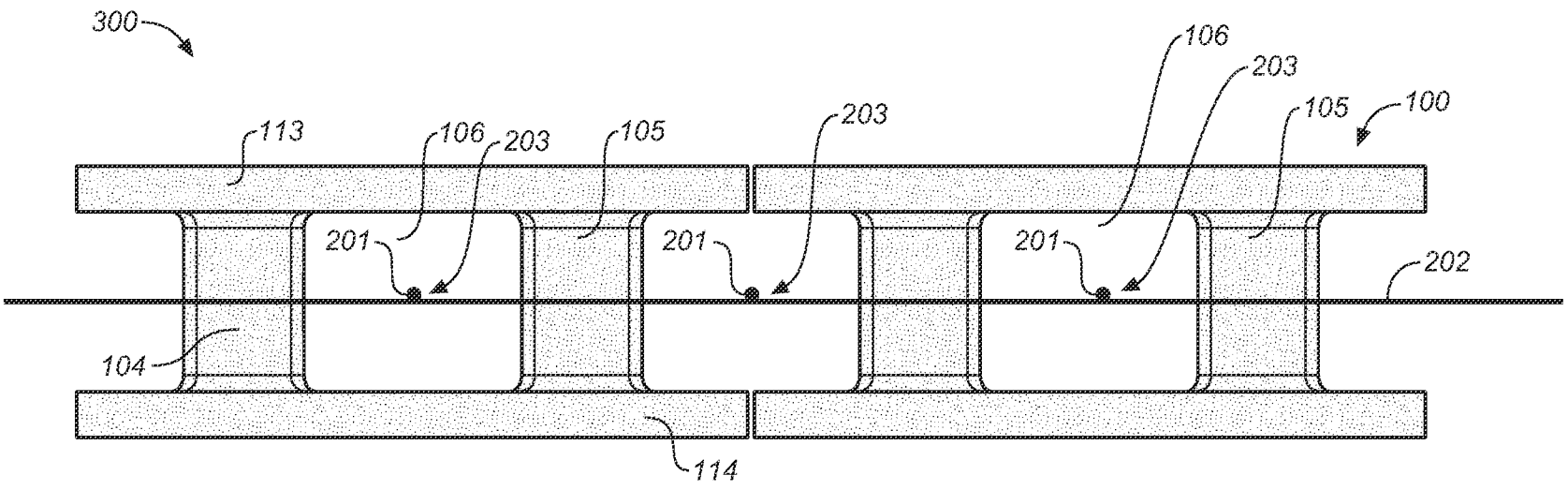
FIG. 9 is a top plan view of masonry blocks in a wall supported on piles according to the invention.
Figure 10:
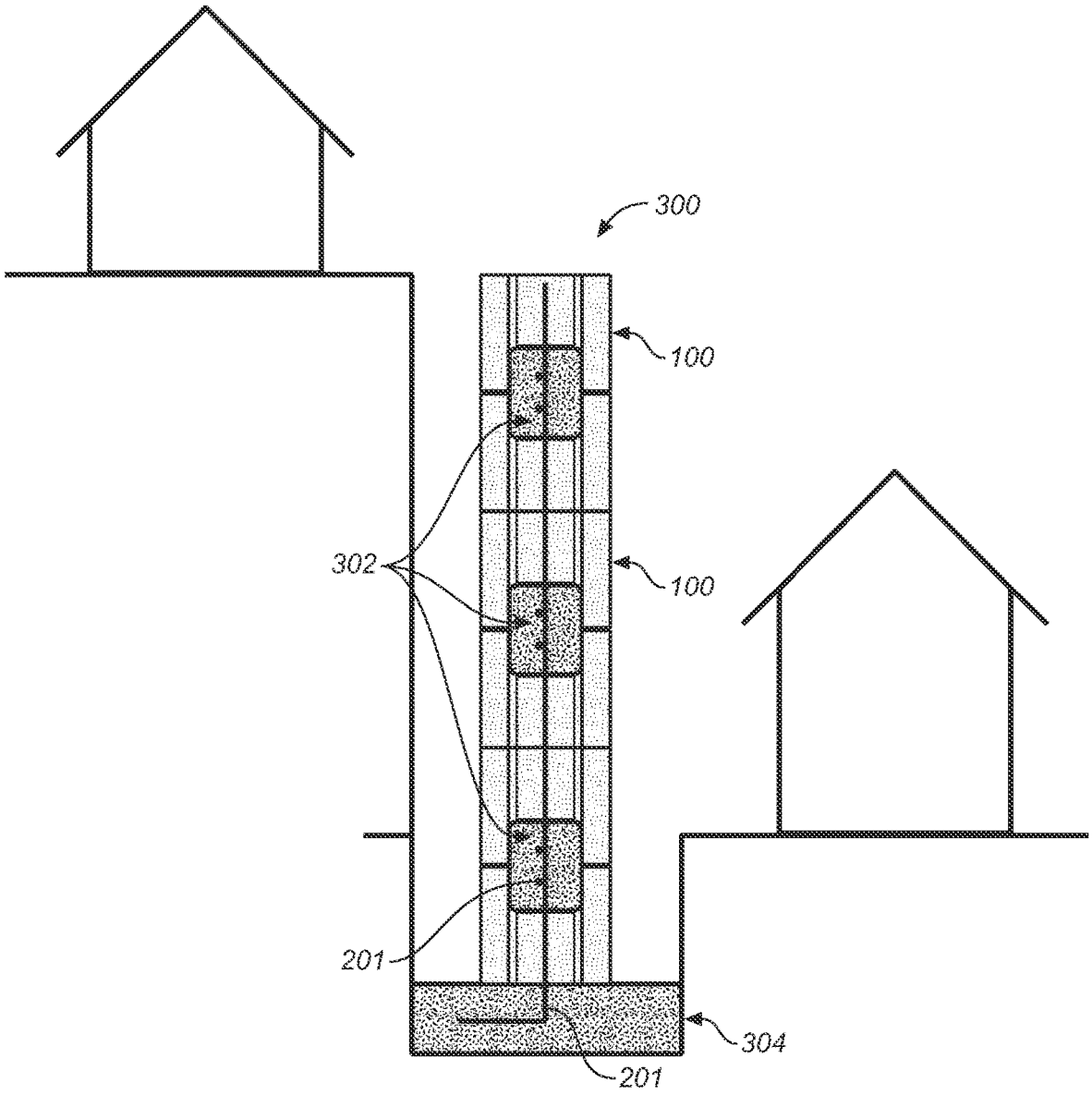
FIG. 10 is a side elevational view of a monolithic retaining wall constructed with masonry blocks and supported on piles according to the invention.

FIG. 5 shows a side elevational view of a wall section formed from top and bottom rows of masonry blocks. Bottom block 100E is shown with an upright vertical orientation with top block 100A in an inverted position on top of bottom block 1003, such that the top edges 1133 and 1143 of bottom block 100B align with the top edges 114A and 113A of top block 100A respectively, Three rows of blocks shown in FIG. 7 follow the stacking configuration shown in FIG. 5 to form part of a wall. As seen, the bottom row of blocks 100B and the top row of blocks 100A are also staggered horizontally to create extended vertical channels 120, emphasized by the bold broken lines, formed from the vertical center channels 106 and the vertical end channels 107 at the open ends of the blocks 100, and extended horizontal channels 121, emphasized by the bold broken lines, formed from the horizontal channels of the blocks 100. As shown in FIGS. 8 and 9, one or more vertical reinforcement bars 201 are inserted through each vertical channel and one or more horizontal reinforcement bars 202 are inserted through each horizontal channel 121. The vertical and horizontal reinforcement bars can be interlocked at points 203 and 204, as seen in FIGS. 6 and 8, to form a mesh. As seen in FIG. 10, once the wall has been dry-stacked to a desired height, the horizontal and vertical channels are filled with grout 302 which, when hardened, embeds the reinforcement bars 201 in a footing 304 and secures the blocks in place to form a monolithic wall.

The masonry blocks, when stacked as discussed above, result in a sturdy wall structure that is robustly reinforced by the vertical and horizontal web of bars. Advantageously, the needs for grade beam footings and for transporting, mixing and troweling mortar are eliminated.

Wall Supported on Hollow Piles

Figure 11:
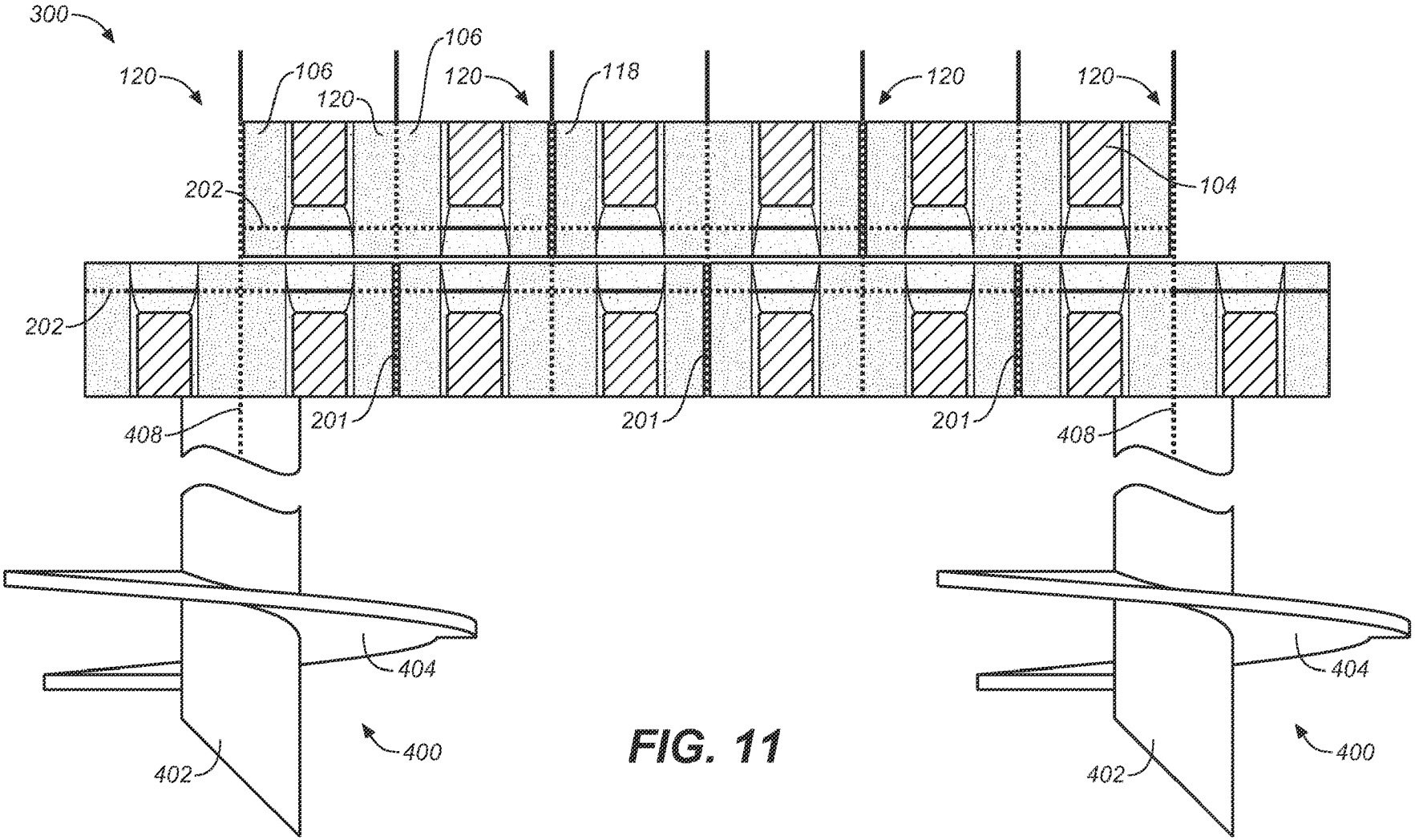
FIG. 11 is a front elevational view similar to FIG. 8 of a partially constructed wall according to another embodiment of the invention.
Figure 12:
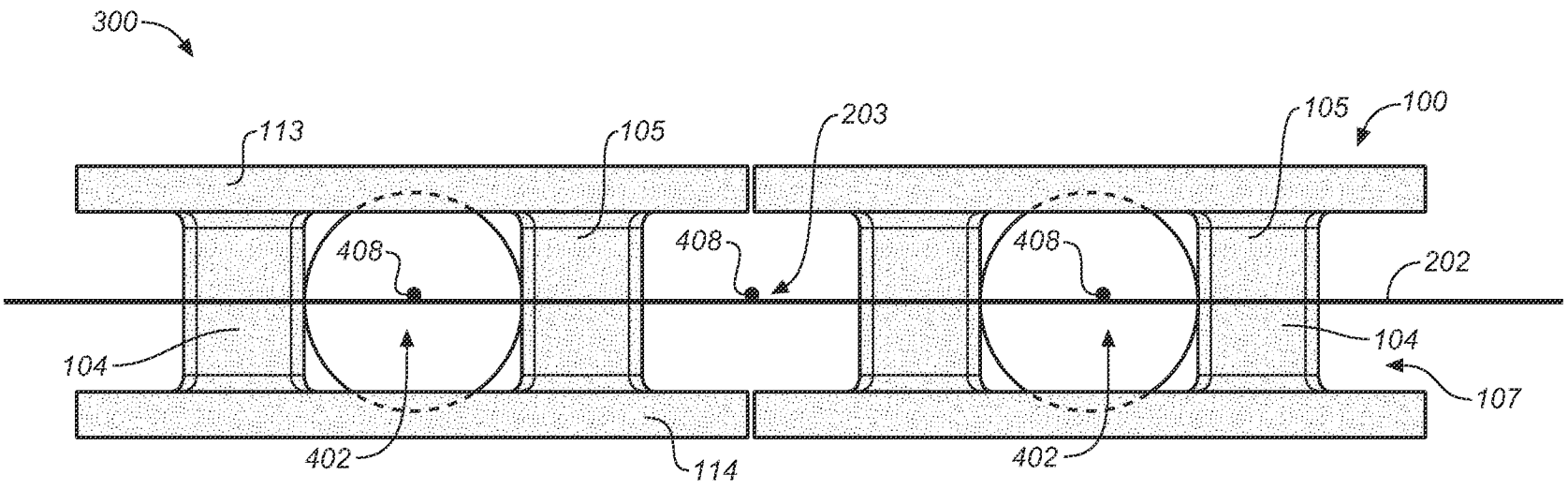
FIG. 12 is a top plan view thereof, similar to FIG. 9.
Figure 13:
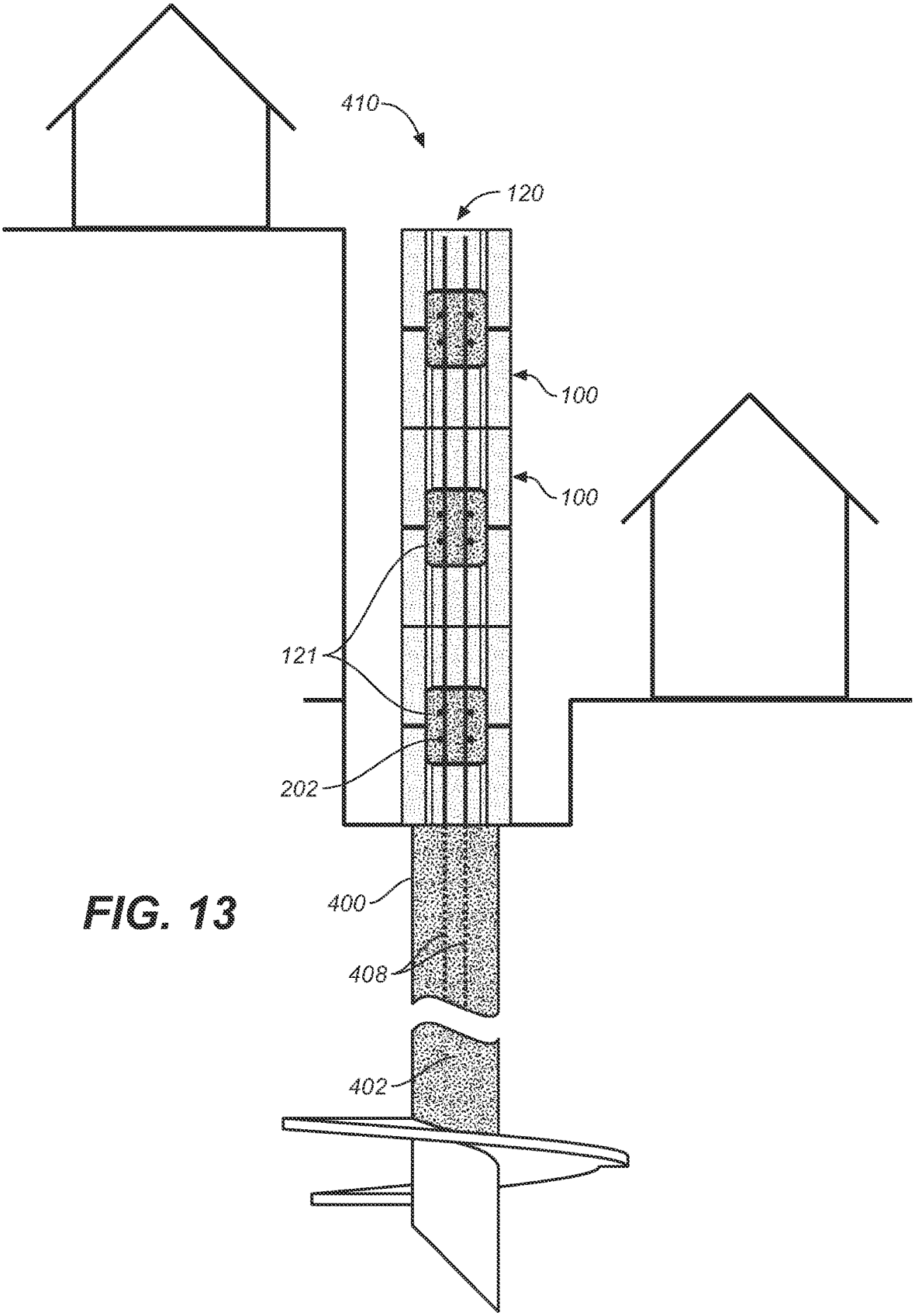
FIG. 13 is a side elevational view thereof, similar to FIG. 10.

In another embodiment of the invention, seen in FIGS. 11-13, a monolithic wall is constructed of masonry blocks 100, as discussed above, but supported on hollow piles 400 instead of a poured foundation. In the illustrated embodiment, the piles 400 are rotary barrel piles having a hollow interior 402 and a helical flight 404 for rotating the pile into the soil. It will be understood that other types of piles having a hollow interior suitable for accepting grout may be employed for supporting a masonry wall according to the invention.

With reference to FIGS. 11 and 12, it is seen that each pile 400 is disposed beneath and in open communication with one of the extended vertical channels 120 of the wall. It will be understood that the number of vertical channels 120 that are directly supported by a pile 400 is a matter of design choice depending on building site conditions. Vertical reinforcing steel 201 may be installed in vertical channels 120 that are not directly supported by a pile 400. Vertical reinforcing steel 408 extends continuously through vertical channels 120 and into piles 400 that support them. In some embodiments and in accordance with the invention, multiple bars of reinforcing steel may be deployed in the channels of the wall and the interiors of the piles as may be suited to the requirements of the job site.

In some embodiments of the invention, the piles have an outer dimension of 8½" and an inner dimension of 8". However, piles having different dimensions may be selected for use according to the invention as are found suitable for site conditions.

With further reference to FIG. 13, a wall according to the illustrated embodiment is constructed by preparing a surface for the wall and then installing piles 400 in the soil at a suitable spacing. The wall 410 is then constructed as discussed above so that one of the extended vertical channels 120 is disposed in communication with the hollow interior 402 of each pile 400. Horizontal 202 and vertical 201, 408 reinforcing steel is installed in the horizontal and vertical channels 121, 120, following which grout is poured into the channels 121, 120 of the wall and in the hollow interiors 402 of the piles 400 to create a monolithic wall.

A wall comprised of masonry blocks supported on hollow piles is firmly anchored in the soil, has excellent strength, and eliminates the need for a poured foundation and for mixing and troweling mortar, thereby reducing labor, equipment and transportation costs.

There have thus been described and illustrated certain embodiments of a dry-stack masonry wall supported on barrel piles according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A dry-stack masonry wall supported on hollow piles comprising:

a masonry wall having a height, the wall comprising a plurality of rows of masonry blocks, at least one row of said plurality of rows stacked atop another row thereof, each masonry block having a horizontal channel and at least one vertical channel, the horizontal channels of the masonry blocks in each row of said plurality of rows in mutual communication, thereby forming a continuous horizontal channel extending along the length of the row, the vertical channels of the masonry blocks in each row of said plurality of rows in communication with the vertical channels of the masonry blocks in the other rows thereof to form one or more vertical channels extending along the height of the wall, the horizontal and vertical channels intersecting to form a hollow grid within the wall, a plurality of rotary piles for substantially vertical placement in soil for supporting the wall, each rotary pile having a top, a bottom, and a hollow interior extending from the top to the bottom thereof, the tops of the plurality of piles engaged with the wall, the hollow interior of each of the plurality of piles in communication with one of the vertical channels of the wall, grout disposed in the grid of the wall and in the hollow interiors of the piles to monolithically bond the wall and the plurality of piles together.

2. The dry-stack masonry wall supported on hollow piles of claim 1 further comprising:

each masonry block having:

two spaced-apart face shells, and a connector having a substantially horizontal top surface and substantially vertical left and right surfaces, the connector joining the face sheds, the top surface of the connector and the face shells forming said horizontal channel, and each of the left and right surfaces and the face shells forming one of said at least one vertical channels.

3. The dry-stack masonry wall supported on hollow piles of claim 2 further comprising:

the face shells of each masonry block having a connector edge and a free edge vertically opposite the connector edge, the connector of each masonry block having a bottom surface that is coplanar with the connector edge of the face shells, and said plurality of rows of masonry block including:

a first row of a plurality of masonry blocks disposed in an upright orientation, and a second row of the masonry blocks disposed on top of the first row in an inverted orientation, such that the horizontal channels of the masonry blocks of the first and second rows of masonry blocks are in open communication.

4. The dry-stack masonry wall supported on hollow piles of claim 1 further comprising:

said rotary piles comprising barrel piles.

5. The dry-stack masonry wall supported on hollow piles of claim 1 further comprising:

the blocks comprising at least one of the group consisting of cast concrete, foam concrete, fly ash, bottom ash, sand or gravel.

6. A method of budding a dry-stack masonry wall supported on hollow piles, the method comprising:

installing a plurality of rotary piles in soil for supporting a plurality of rows of masonry blocks, said plurality of rows of masonry blocks including a first row and a second row, each pile of the plurality of piles having a hollow interior, laying the first row of masonry blocks on top of the plurality of rotary piles, laying a second row of masonry blocks atop the first row, each of the masonry blocks in said first and second rows having a horizontal channel and at least one vertical channel {intersecting the horizontal channel}, disposing the masonry blocks so that the horizontal channels of the masonry blocks in each said row are in common communication, positioning the masonry blocks so that at least one of the vertical channels of each block in each of said first and second rows is in communication with one of the vertical channels of a block in the other of said rows, such that the horizontal and vertical channels of the blocks of the first and second rows meet to form a hollow grid, disposing the masonry blocks in said first and second rows so that at least one of the vertical channels thereof is in communication with the hollow interior of one of the plurality of piles, filling the hollow grid of the masonry blocks and the hollow interiors of the plurality of piles with grout to bond the blocks of the first and second rows of masonry blocks and the plurality of piles together to form a wall supported on said piles.

7. The method of budding a dry-stack masonry wall supported on hollow piles of claim 6 further comprising:

disposing the first row of masonry blocks in an upright orientation, each masonry block of said first and second rows having:

two spaced-apart face shells, the face shells having a connector edge and a free edge opposite the connector edge, and a connector having a bottom surface, a substantially horizontal top surface and substantially vertical left and right surfaces, the connector joining the face shells, the top surface of the connector and the face shells forming said horizontal channel, and each of the left and right surfaces and the face shells forming one of said at least one vertical channels, and disposing the second row of masonry blocks in an inverted orientation so that the horizontal channels of the masonry blocks of said first and second rows are in open communication.

* * * * *